United States Patent [19]

Melan et al.

[11] 4,193,557

[45] * Mar. 18, 1980

[54] STRAND ATTENUATION AND WINDING APPARATUS

[75] Inventors: Giuseppe-Fabrizio M. Melan, Chambery; Jean R. Nicouland, Challe-les-Eaux, both of France

[73] Assignee: Saint-Gobain Industries, Neuilly-sur-Seine, France

[ * ] Notice: The portion of the term of this patent subsequent to Aug. 9, 1994, has been disclaimed.

[21] Appl. No.: 822,208

[22] Filed: Aug. 5, 1977

Related U.S. Application Data

[62] Division of Ser. No. 630,925, Nov. 11, 1975, Pat. No. 4,040,572.

[30] Foreign Application Priority Data

Nov. 13, 1974 [FR] France ..... 74 47434

[51] Int. Cl.[2] ..... B65H 54/02

[52] U.S. Cl. ..... 242/18 A

[58] Field of Search ..... 242/18 A, 18 PW, 18 E, 242/125.1, 18 G

[56] References Cited

U.S. PATENT DOCUMENTS

| | | | |
|---|---|---|---|
| 3,345,003 | 10/1967 | Mattingly et al. | 242/18 A |
| 3,741,488 | 6/1973 | Wuest | 242/18 PW |
| 3,876,161 | 4/1975 | Miller | 242/18 PW |
| 3,936,006 | 2/1976 | List et al. | 242/18 A |
| 4,040,572 | 8/1977 | Melan et al. | 242/18 PW |

FOREIGN PATENT DOCUMENTS

| | | | |
|---|---|---|---|
| 47-5220 | 2/1972 | Japan | 242/18 PW |

*Primary Examiner*—George F. Mautz

*Attorney, Agent, or Firm*—John T. Synnestvedt; Charles H. Lindrooth

[57] ABSTRACT

Apparatus and method for winding a continuous strand formed from an attenuable material is disclosed. The winding collet has a starting drum mounted on one end. An end face of the starting drum includes diametrically opposed strand engaging members that engage the strand as it is brought against the face of the starting drum. The strand is conducted from the strand engaging means to the starting drum and is wound on the starting drum until the winding collet reaches operating speed. When the winding collet is at its operating speed, the strand is urged away from the starting drum and onto the winding collet to form the winding.

7 Claims, 29 Drawing Figures

1
2
50
50
3
12
15
16
14
6
11
13
9
8
10
5
4
7
18
19
20
17

FIG. 9
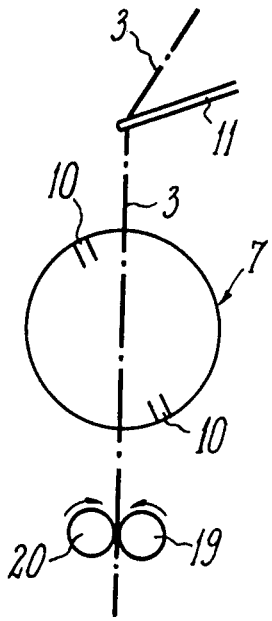
FIG. 10
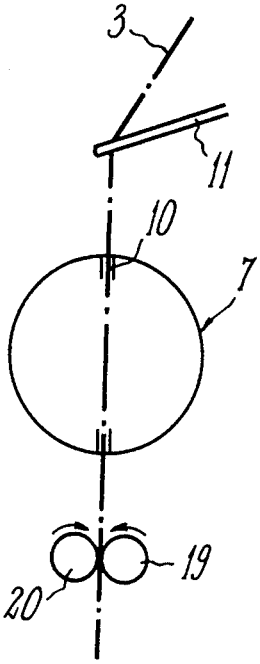
FIG. 11
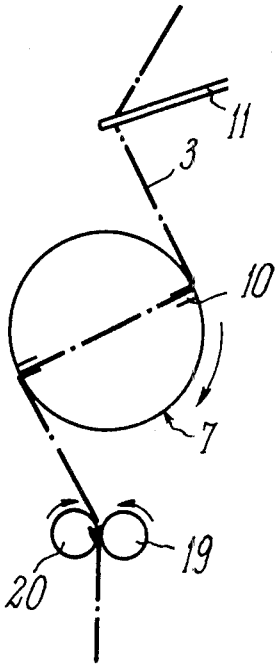
FIG. 12
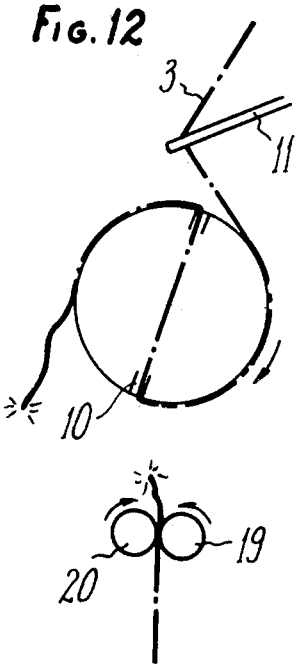
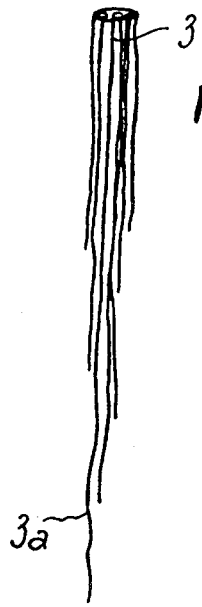
FIG. 14

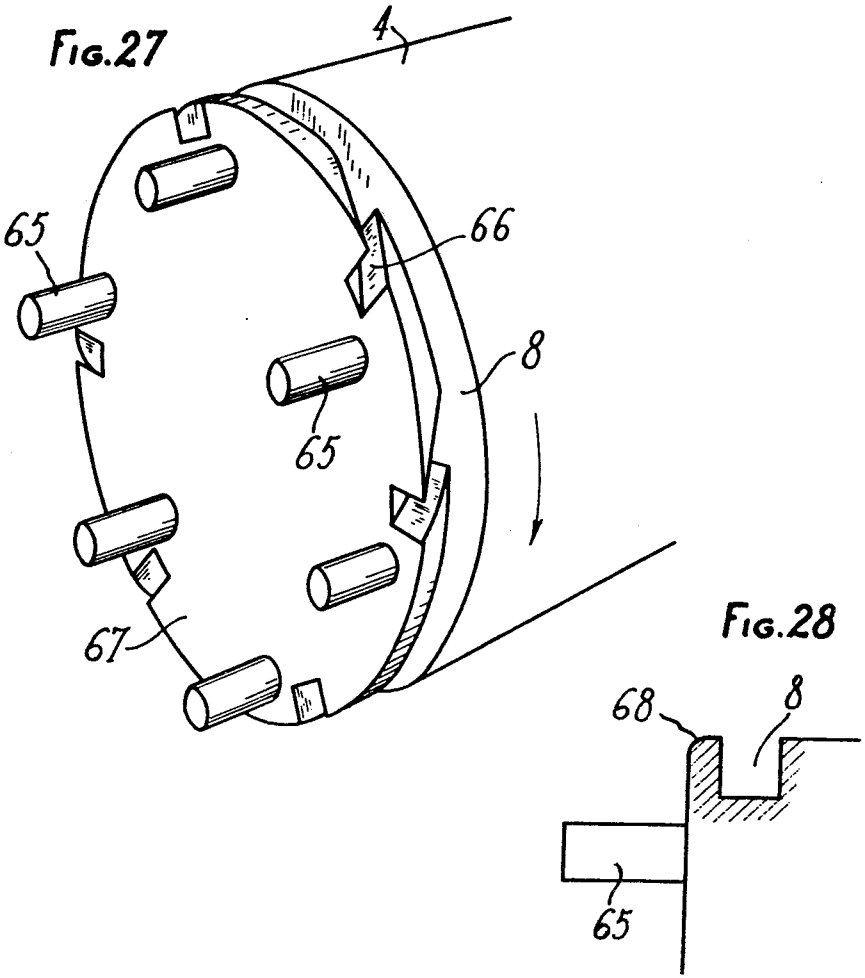
FIG. 27
FIG. 28
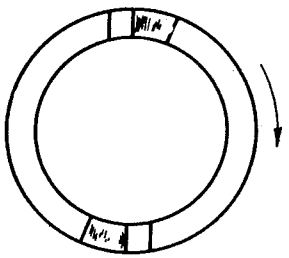
FIG. 25
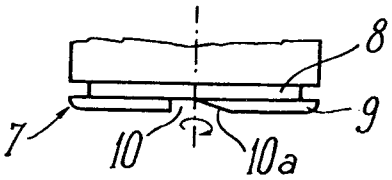
FIG. 24
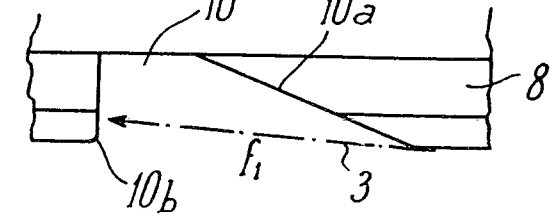
FIG. 26

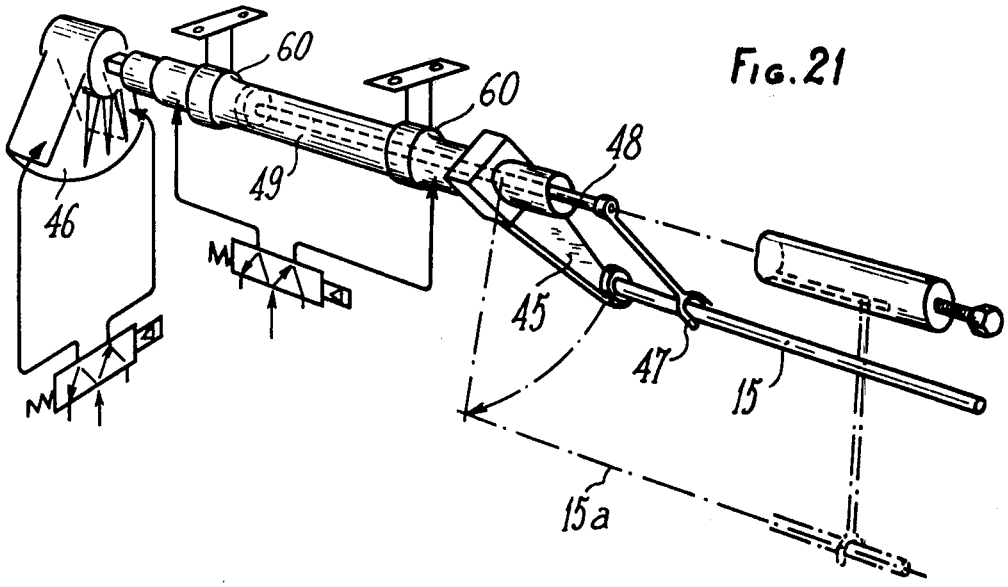
Fig. 21
Fig. 23
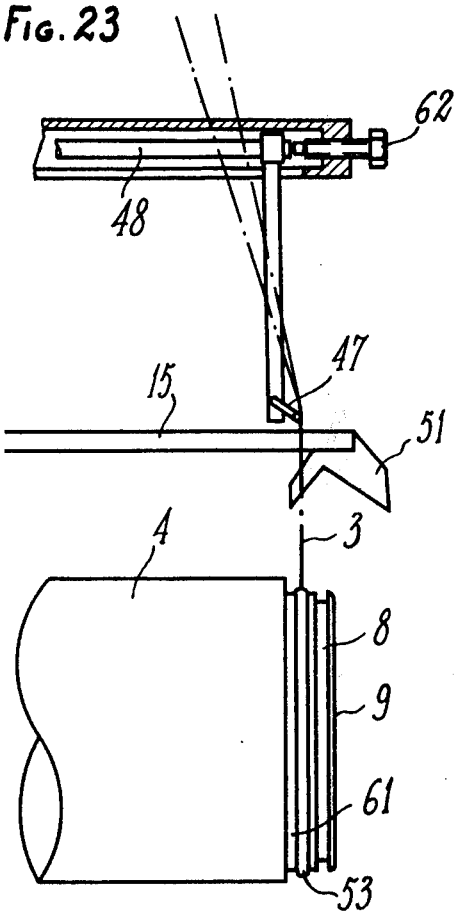
Fig. 22
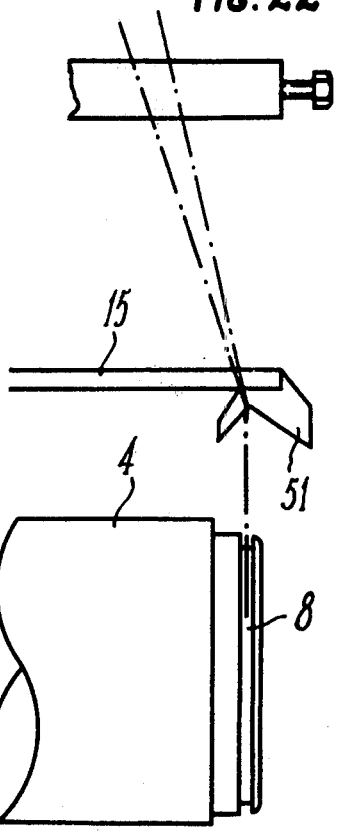

STRAND ATTENUATION AND WINDING APPARATUS

This is a division, of application Ser. No. 630,925, filed Nov. 11, 1975, now U.S. Pat. No. 4,040,572.

FIELD OF THE INVENTION

The present invention relates to the manufacture of strands from attenuable material, for example, a thermoplastic material such as glass, the strands being obtained from streams of the attenuable material that flow from orifices of a bushing and thereafter harden into filaments.

BACKGROUND OF THE INVENTION

The manufacture of strands from attenuable, thermoplastic materials, for example, glass, by pulling streams of the attenuable material from the orifices of the bushing is, of course, a known process. In this process, the streams of attenuable material harden and solidify into filaments as they are drawn away from the orifices in the bushing. A strand composed of a number of these filaments is wound on a sleeve mounted on a rotating collet. This winding subjects the strand, including the streams of material drawn from the orifices, to a pull or tension that draws out, i.e. attenuates, the portions of the filaments that are not yet hardened or solidified.

In such winding operations, it is necessary from time to time to restart the winding operation, after an interruption, by winding the strand on a new sleeve. The strand wound on each sleeve must be subjected to an unvarying attenuation process throughout the length of the winding so that the diameter of the strand is held as constant as possible. This is accomplished principally by winding the strand at a constant speed. With nonautomatic winders (winders having only a single collet that must be stopped when the the winding is at capacity, the finished winding manually removed, and a new winding started on the same collet), such restarts are necessary each time a full winding is removed and each time there is a strand rupture. With automatic winders (winders having two or more collets mounted on a turret and mechanism for automatically commencing winding on an empty collet after the winding on a preceding collet has reached capacity) such restarts are necessary after strand ruptures.

However, it should be realized that when the strand prematurely ruptures or when the strand pulling operation is interrupted by the necessity of removing a winding that is at capacity, the pulling operation is slowed or stopped. When the strand is drawn slowly, the streams of attenuable material form relatively large diameter filaments. It is undesirable to have strand formed of these relatively large diameter filaments in a winding, as the winding would be unacceptable to users of the product because of the variations in the diameter.

Prior to this, with nonautomatic winders, following the completion of each winding and each time the strand ruptured prematurely during winding, the restarting operation involved the use of two men, one above the winder to pull the filaments from the bushing to restart the filament formation at the bushing and a second man at the level of the winder who, in either case, removed the winding on the collet and restarted a new winding on the collet. In the case of automatic winders it was also necessary to employ two men to restart the winding operation in the event of a strand rupture. The restarting operation in the event of strand rupture with automatic winders is essentially the same as that explained previously with respect to nonautomatic winders. These prior restarting procedures have several disadvantages. They required the use of two men and the attendant high labor costs. Also, because the labor force in the winding operation was split into two groups, those at the level of the bushings and those at the level of the winders, it was often the case that, while two men were attending to a rupture, or in the case of nonautomatic winders, the removal of the finished winding from a collet, that other ruptures or completion of windings at other winders would occur. These could not be attended to until the two men had completed a restart of the first interrupted operation and this resulted in losing winder utilization time and also resulted in the loss of significant amounts of glass.

The invention described and claimed herein provides for the restarting of the winding operation by a man at the level of the bushings. It is possible to reduce the number of men at the level of the winders, as it is only necessary for them to remove full or practically completed strand windings and it is not necessary for them to take the time to work with the man at the bushing level to restart the winding. This allows the man at the bushing level to effect the restart or the reset of the winding more quickly and significantly reduces winder down time and the amount of glass lost during strand ruptures.

SUMMARY OF THE INVENTION

In accordance with the method aspects of this invention, the following operations are effected:

the strand is engaged by strand pulling means that cause attenuation of the strand;

the strand is brought into proximity with strand engaging means associated with the collet and the strand is engaged by the strand engaging means and wound on a starting drum as the collet is set to rotation;

the strand is maintained on the starting drum during the time that the collet is brought to its operating speed and during this time the strand is attenuated;

when the collet has reached its operating speed, the strand is shifted from the starting drum to a winding sleeve mounted on the collet.

In accordance with apparatus aspects of the invention, the strand is drawn into proximity with a free front face of a starting drum associated with the winding collet and is seized by strand engaging means placed on the circumference of the starting drum that leads strand into a circular groove provided on the starting drum. A guide element maintains the strand aligned with the groove of the starting drum until the collet has reached its normal winding speed. In accordance with a specific aspect of the invention, the strand engaging means comprise two opposed elements positioned along a diameter of the front face of the starting drum. According to a preferred mode of implementation of the invention, the strand engaging elements comprise a pair of slots diametrically arranged on the face of the starting drum and in communication with a groove on the starting drum. The apparatus also includes a strand pulling and guiding device that attenuates the strand and brings it into proximity with the front face of the starting drum to be engaged by the strand engaging means on the starting drum.

The invention is useful in winding installations having nonautomatic winders and also in installations having automatic winders with multiple collets. The invention can be used for winding single strand or multiple strand yarns.

Other characteristics and advantages will be apparent from the following description of the preferred embodiments of the invention, which are presented as examples and are not to be interpreted as limiting the invention claimed.

DESCRIPTION OF PREFERRED EMBODIMENTS

FIG. 9 is a schematic illustration of the strand position corresponding to that shown in FIG. 1.

FIG. 10 is a schematic illustration showing the strand as it is engaged by the strand engaging means.

FIG. 11 is a schematic illustration corresponding to the strand condition shown in FIG. 2, wherein the strand begins winding on the starting drum.

FIG. 12 is a schematic illustration of the strand condition corresponding to FIG. 3 showing the strand position at the time of rupture of the portion of strand disposed between the starting drum and the strand pulling device.

FIG. 14 is a view of a ruptured end of the strand.

Figure 15:
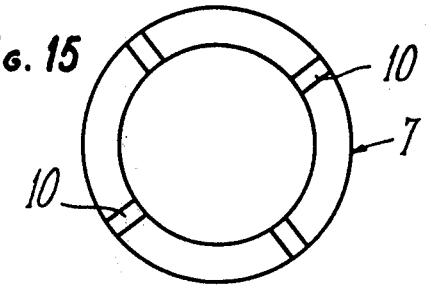
Figure 15A:
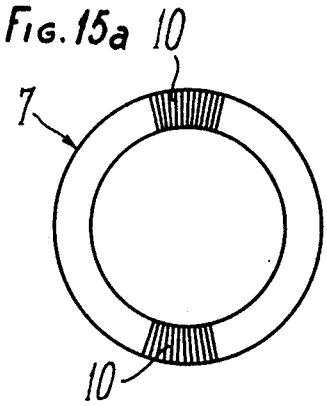

FIGS. 15 and 15*a* are end views of starting drums having more than two slots for engaging the strand.

Figure 16:
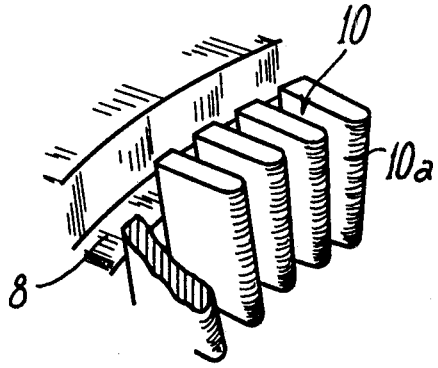

FIG. 16 is a detailed view of one means for forming a plurality of slots on the face of the starting drum.

Figure 17:
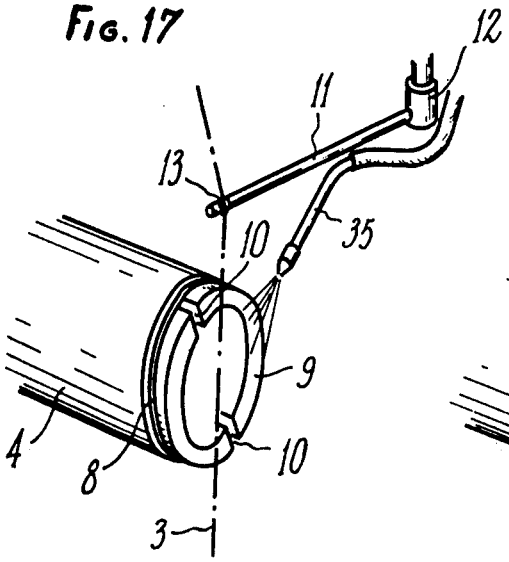

FIG. 17 is a perspective view of the end of a collet showing apparatus for wetting the end face of the starting drum.

Figure 18:
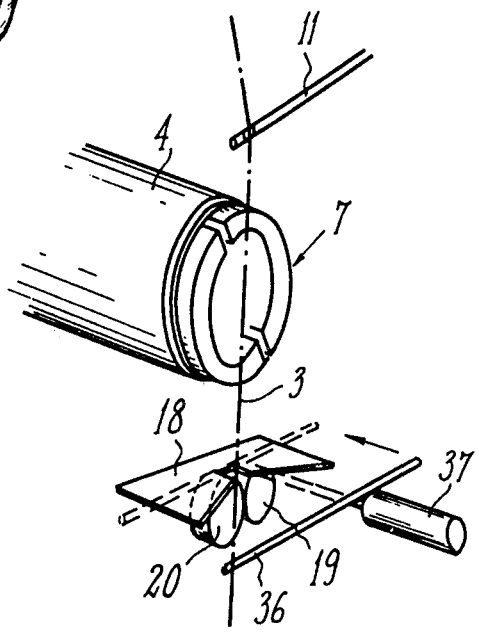

FIG. 18 is a perspective view of one form of apparatus for introducing the strand between the rollers of the strand pulling device.

Figure 19:
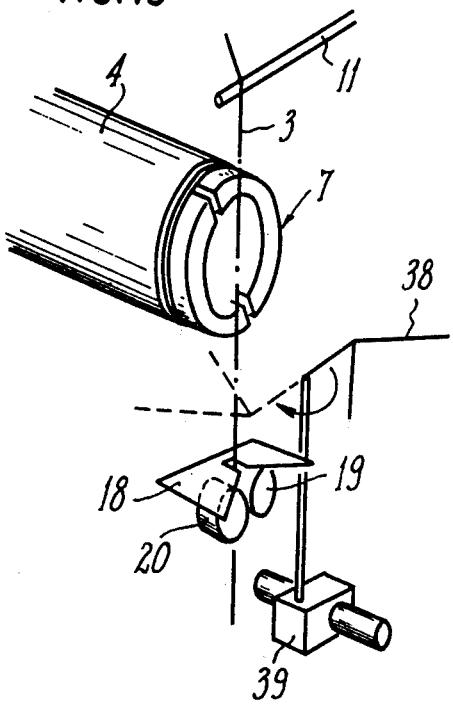

FIG. 19 is a perspective view of another embodiment of means for introducing the strands between the rollers of the strand pulling device.

Figure 20:
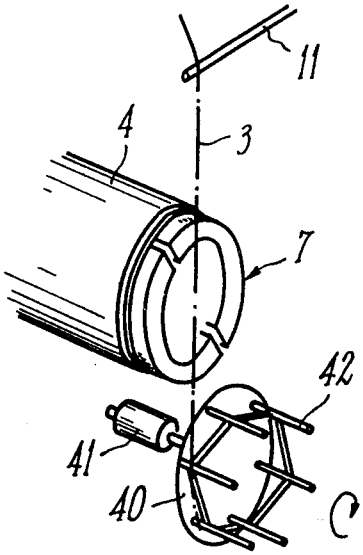

FIG. 20 is a perspective view of another form of strand pulling apparatus.

FIG. 21 is a detailed view in perspective of a strand deflector used as an upper guide for the strand.

FIG. 22 is a detailed elevational view of the strand deflector shown in FIG. 21 showing the guiding of the strand onto the starting drum.

FIG. 23 is a side elevational view of the strand deflector apparatus of FIG. 21 showing the winding of the strand on a smooth part of the collet after winding on the winding sleeve has been completed and preparatory to removal of the completed winding.

FIG. 24 is a partial side elevational view of a modified form of strand engaging means in which the leading edges of the slots are inclined toward the groove of the starting drum.

FIG. 25 is an end view of the starting drum shown in FIG. 24.

FIG. 26 is an expanded illustration of the slot used in the FIG. 24 embodiment of the starting drum.

FIG. 27 is a partial perspective view of a modified form of strand engaging means comprising axially projecting pegs.

FIG. 28 is a partial sectional view of the embodiment shown in FIG. 27.

As shown in FIGS. 1–4, the installation illustrated comprises a bushing 1 producing filaments 2 that are gathered in a strand 3 in a known manner. This strand is wound on a removable winding sleeve disposed on the collet 4. The winders illustrated in these figures are the automatic type employing at least two collets mounted on a rotating turret 5, that serves to position the collet alternatively in a winding position and in a winding removal position. The winder shown employs a conventional spiral traversing means 6 for assuring level winding of the strand on the sleeve.

Again referring to FIGS. 1–4, a starting drum 7 is mounted on the free end of each of the collets 4. The starting drum has a groove 8 for receiving strand and a pair of diametrically arranged slots 10 in the face 9. The slots extend from the face 9 to the groove 8 and permit communication between the face and the groove. The face 9 is smooth and highly polished so that abrasion of the strand is minimized as it is brought into contact with the face 9.

Figure 13:
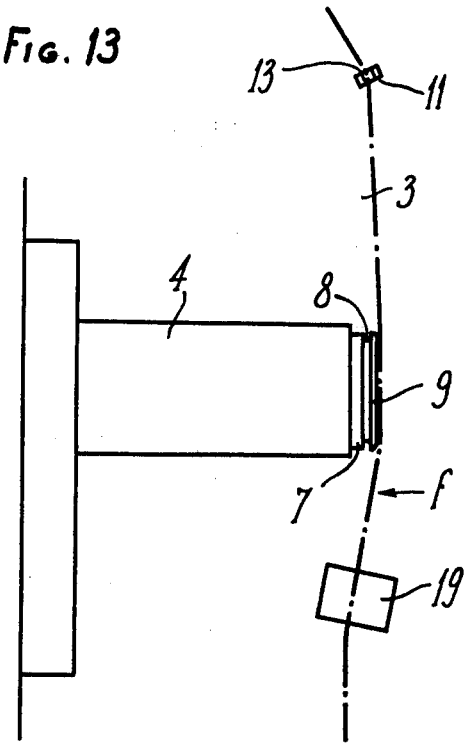
FIG. 13 is a schematic side elevational view showing the positional relationships between the strand pulling device, the starting drum, and the strand retaining finger.

Referring to FIGS. 1–4 and also to FIG. 13, a finger 11, is displaced vertically from the axis of rotation of the collet. This finger is mounted on a support 12, in such a manner that the groove 13 is carried at the end of finger 11 remains in a fixed position with respect to the starting drum 7.

A strand deflector element 14 is mounted on a bar 15, the bar 15 being mounted on an arm pivotally mounted at 16. The deflector element 14 is composed of a small plate of material resistant to erosion caused by frictional engagement with the moving strand. The element 14 is positioned in such a way that when the bar 15 is pivoted to its functioning position, the element 14 urges the strand out of the groove 13 of the finger 11 and momentarily holds the strand in this position. When the bar 15 is pivoted to its functioning position, the strand is brought into engagement with level winding mechanism 6 and the winding of the strand package on the collet is commenced.

A strand pulling device 17 is placed beneath the collet 4 that is positioned to have a winding of strand started thereon. The pulling device 17 comprises a V-shaped guide 18 that guides the strand into position between two rollers 19 and 20. The base of the V-shaped guide is slightly recessed beyond the face 9 of the starting drum 7 so that strand drawn between the rollers 19 and 20 can move in the direction of the axis of collet 4 against the face 9.

Figure 7:
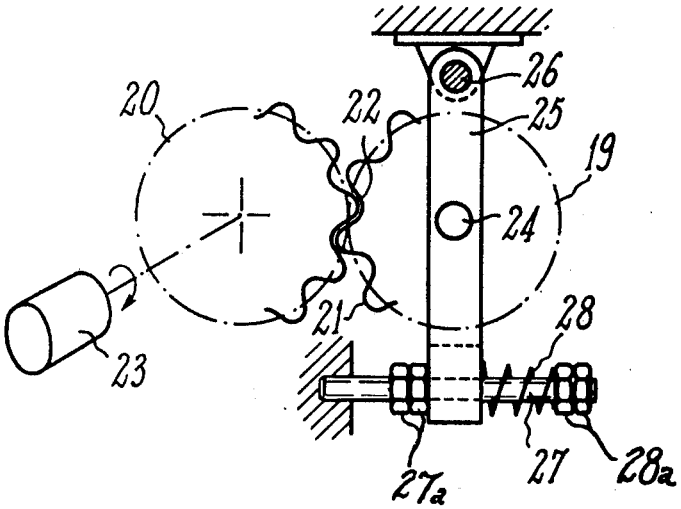
FIG. 7 is a detailed view of the rollers of the strand pulling device.

As illustrated in FIG. 7, in a preferred embodiment, the rollers 19 and 20 comprise cogs having rounded teeth 21. The roller 20 is driven by a motor 23 and roller 20 in turn drives roller 19 that is mounted for rotation about an axle 24. Means are provided for adjusting the distance between the pitch circles 22 of the respective rollers 19 and 20, thereby providing for adjustment in the clearance between the rollers. The axle 24 is carried by arm 25 that is mounted on a pivot 26. Thus it can be seen that the roller 19 is mounted for movement toward and away from the roller 20 by means of the pivoted arm 25. The other end of the arm 25 slides on a guide 27. Stops 27*a* are movable along guide 27 provide for adjustable clearance between the rollers 19 and 20. The spring 28 resiliently biases the arm 25 against the stops 27*a*. The stops 28*a* are movable along the guide 27 and provide for adjusting the bias force of the spring 28. This set-up provides for adjusting the clearance between the rollers and for adjusting the gripping force applied to the strand by the rollers. As is explained later, it is important to regulate the pressure exerted on the strand by rollers 19 and 20 so that the strand ruptures in a desired fashion.

As it will be explained hereinafter in reference to FIG. 13, the axes of rotation of the rollers 19 and 20 are inclined approximately 5° with respect to the axis of rotation of the collet 4.

The apparatus just described is used and functions in the following manner.

Figure 1:
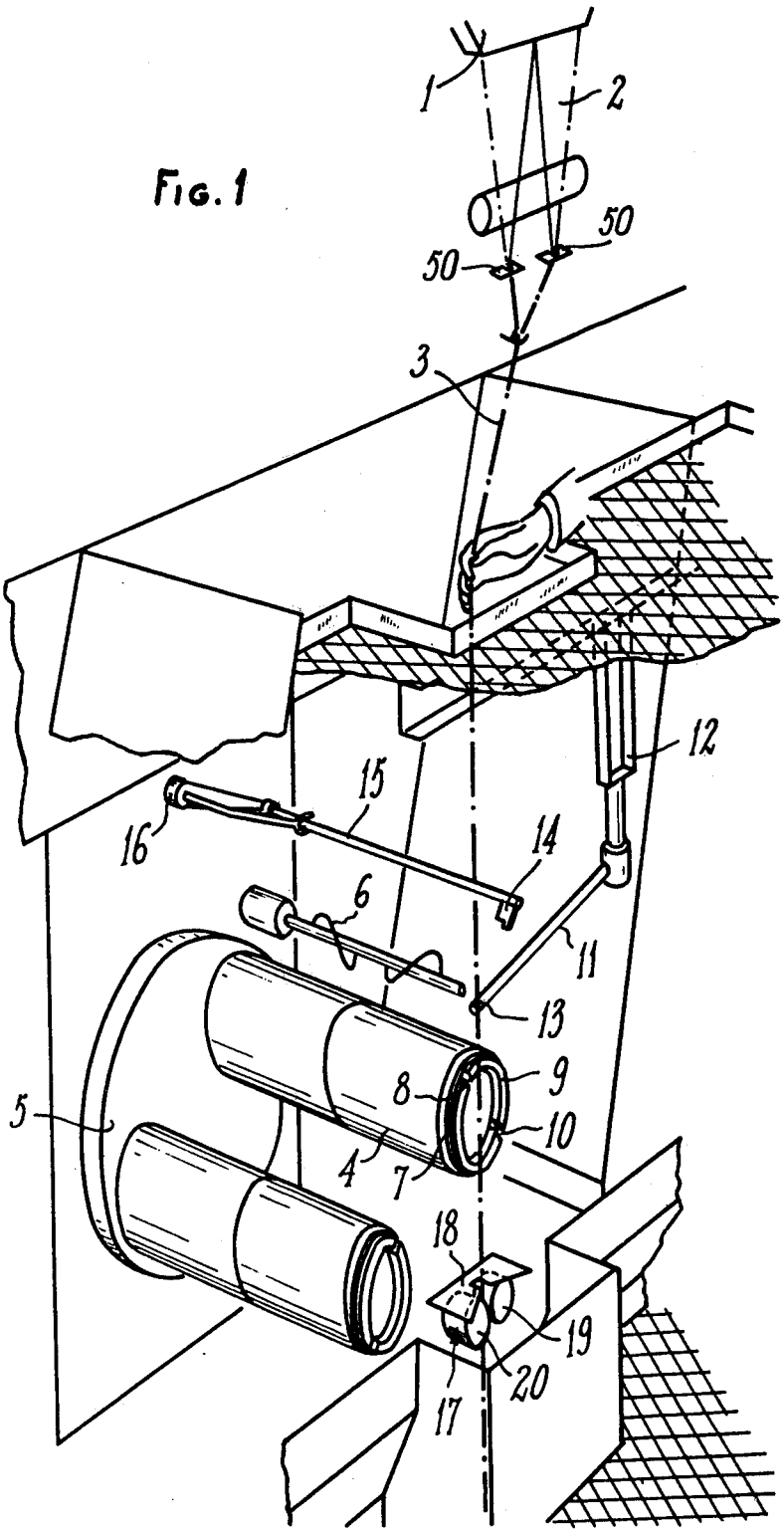
FIG. 1 is a perspective view showing an automatic winder with two collets, to which the invention is applied, the strand being shown engaged in the strand pulling device and not yet engaged by the starting drum.
Figure 2:
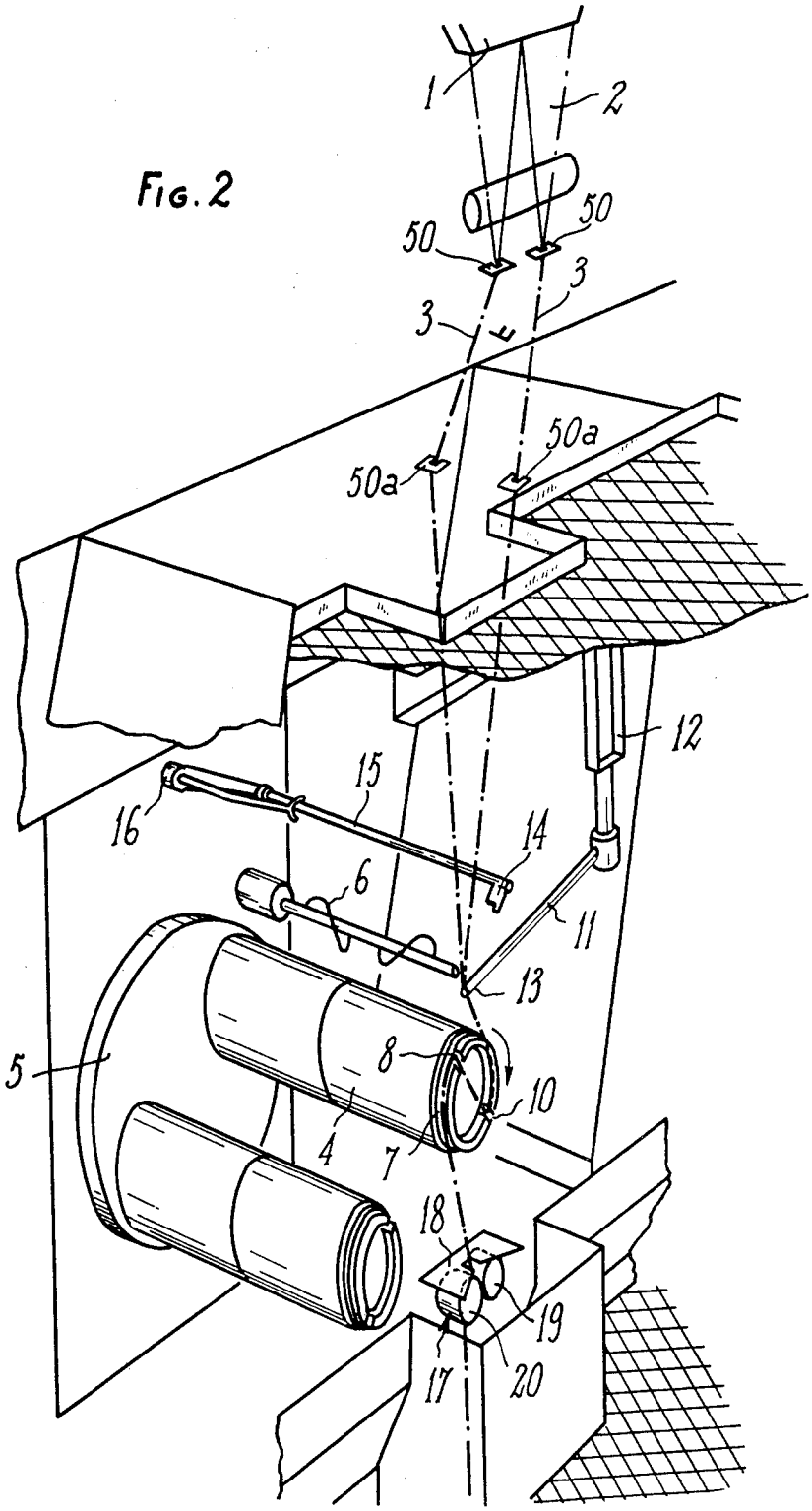
FIG. 2 is a view of the winder shown in FIG. 1 with the strand engaged by the strand engaging means on the starting drum associated with a collet, the strand being held at its lower end by the strand pulling device.
Figure 3:
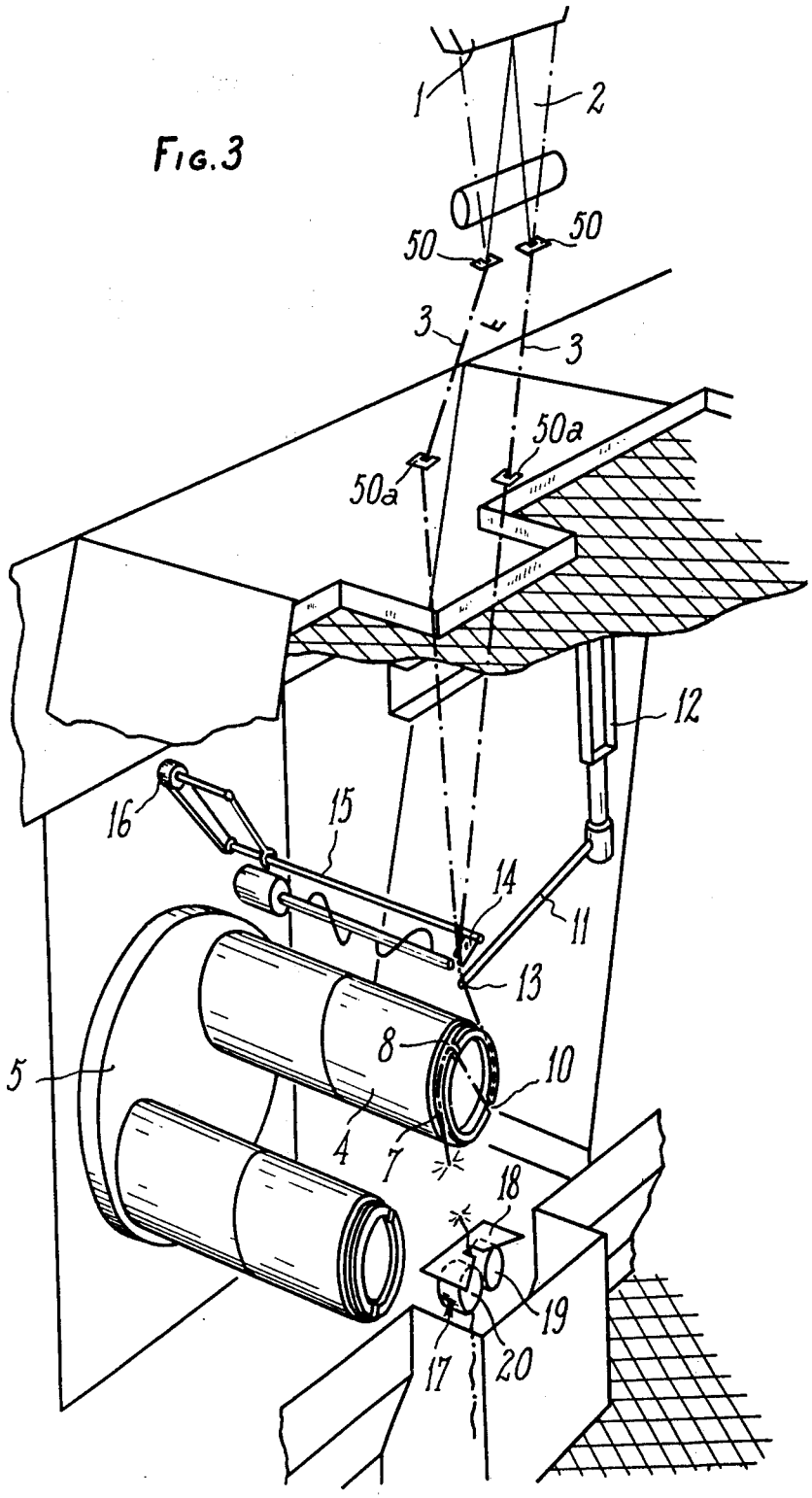
FIG. 3 is a view of the winder shown in FIG. 1, and further shows rupture of the portion of strand disposed between the starting drum and the strand pulling device and winding of the strand on the groove of the starting drum.
Figure 4:
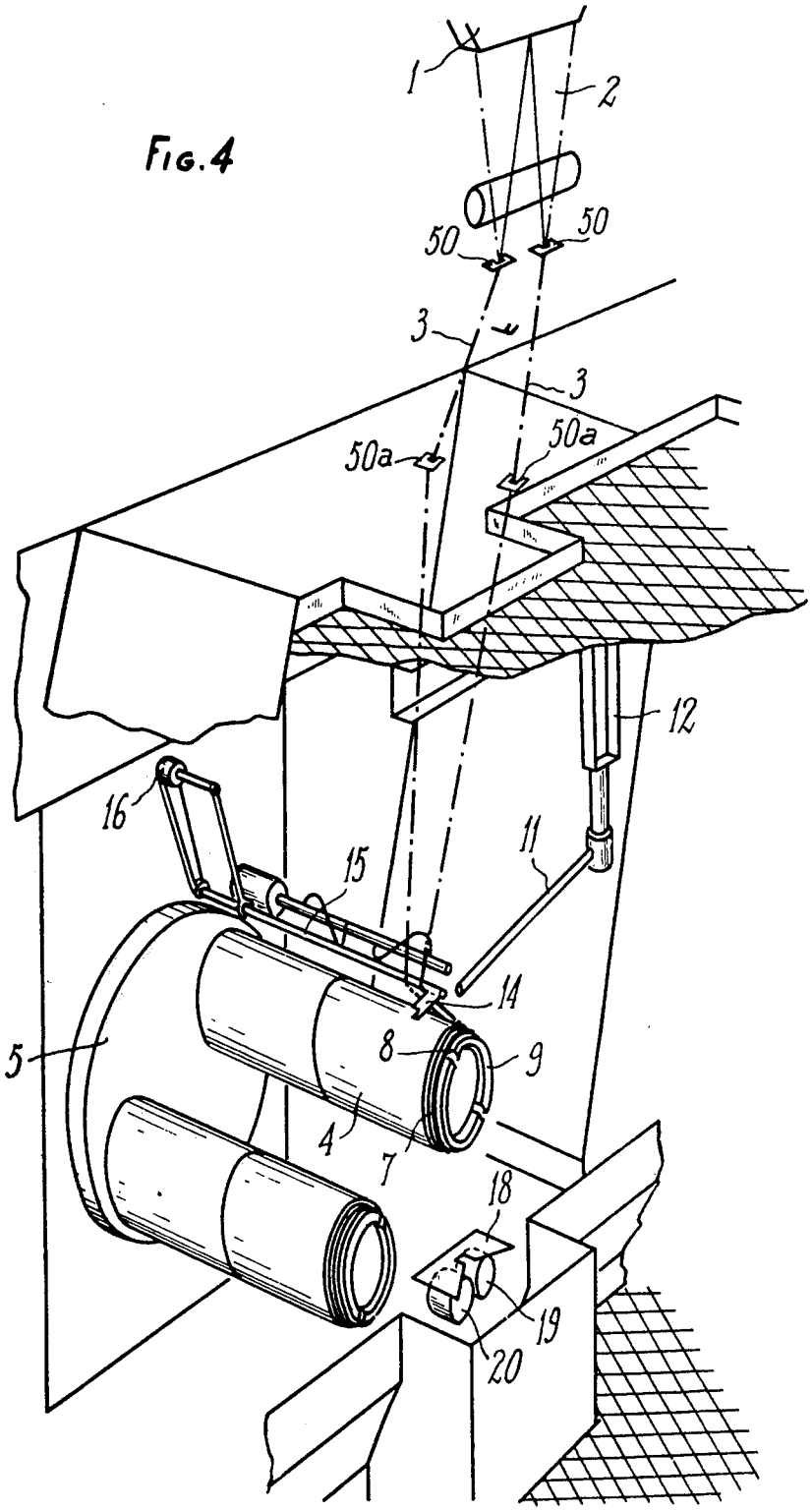
FIG. 4 is a view of the winder as shown in FIG. 1, and further shows the shifting of the strand from the starting drum onto a sleeve on the winding collet, after the collet has reached its operating speed.
Figure 5:
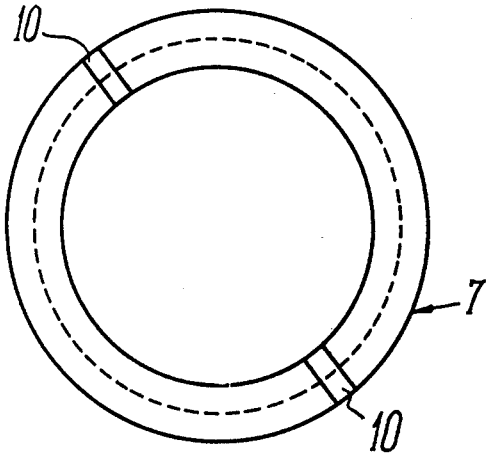
FIG. 5 is an end view of a starting drum.
Figure 6:
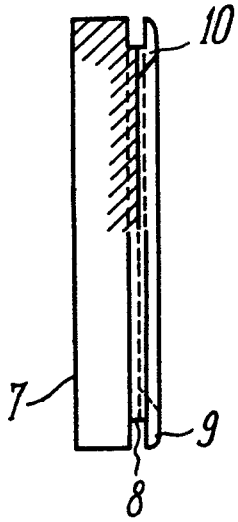
FIG. 6 is a side elevational view of a starting drum.

A worker at the bushing level gathers the filaments issuing from the bushing and pulls a length of strand sufficient to reach the pulling device 17. The worker guides the strand into the V-shaped guide 18, so that the strand is engaged by the rollers 19 and 20. The strand is also engaged on the finger 11 and is held on a centered position with respect to the face 9 by the groove 13. While the strand puller attenuates the strand at slow speed, one can proceed to separate the filaments into bundles in order to form two or more small diameter strands. This is accomplished by positioning groups of filaments in the separating combs 50 and countercombs 50*a* (FIGS. 2, 3 and 4).

The strand pulling device draws the strand at a slow rate and while doing so, draws the strand against the face of the starting drum, as shown in FIG. 13. As the collet begins rotating, the strand enters the two slots 10 and is held without being able to slide (as shown in FIG. 2). As the collet continues to rotate the strand is ruptured in the portion between the strand puller 17 and the collet (as shown in FIG. 3).

Figure 8:
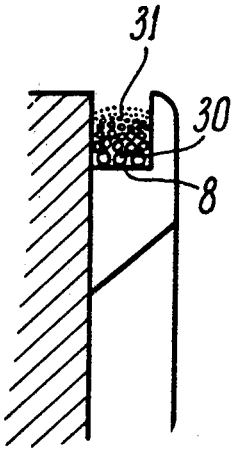
FIG. 8 is a partial cross-sectional view of the starting drum showing strand wound in the groove.

During the start-up of the winding operation and until the collet reaches its normal operating speed, the strand is wound in groove 8. This groove permits the localization and retention of strand composed of large diameter fragile filaments 30 (as shown in FIG. 8) which are susceptible to breakage and separation under the action of centrifugal force. During this start-up operation, as the speed of the collet increases, the strand becomes progressively finer and this finer, more breakage resistant strand 31 covers the large diameter filaments 30 at the base of the groove 8 and forms a protective binding over them.

A time switch controls the pivoting of the bar 15. After a predetermined length of time sufficient for the collet to reach its operating speed, an electrical time switch (not shown) causes operation of means for pivoting the bar 15. Such means can be an electrically actuated valve (for example as shown in FIG. 21) that controls the flow of fluid to a fluid motor for moving the bar 15 from its rest position to its working position (as shown in FIG. 4). As heretofore explained, when the bar 15 moves to its working position, the deflector element 14 disengages the strand from the retaining finger 11, the strand being retained by the element 14. A second electrical signal given by the time switch after a calculated delay, immediately returns the bar 15 to its rest position. During the time the bar 15 is in its working position, the strand is engaged by the level line mechanism 6 and begins traversing the winding sleeve.

When the winding is completed, in the case of a non-automatic winder, the worker at the winder level stops the collet and removes the winding. In the case of an automatic winder, the collet carrying the full sleeve is moved out of the winding position and the collet with an empty sleeve is moved in position to receive the strand and begin a new winding. The ring of strand formed in the groove 8 of the starting drum is removed by cutting it and lifting it out of the groove.

FIG. 13 shows the position of roller 19 and the retaining finger 11 in respect to the face 9 of the starting drum. It should be noted that in this view, roller 20 is not shown. Roller 20 is in the same vertical position as roller 19 and is inclined in the same direction as roller 19. The axes of the rollers 19 and 20 are inclined at a slight angle to the horizontal, approximately 5°. Further, the groove 13 of finger 11 is recessed in the direction of the axis of rotation of the collet 4 with respect to the face 9. As a result of the foregoing structural relationships, when the strand is drawn by the pulling device 17, the strand is held against the face 9 of the drum and the result of this is that the strand enters the slots 10 when the slots are aligned with the strand. Further, the inclination of the axes of rotation of the rollers 19 and 20 as shown causes the strand to be pulled in the direction of the arrow f into base of the V-shaped guide 18. This allows the strand to engage the face 9 and enter the slots 10.

At the time the collet is set into rotation and after catching the strand in the slot 10, the portion of the strand situated between the starting drum and the strand pulling device 17 is subjected to two traction efforts in opposing directions and this produces a rupture of the filaments. It should be realized that because the strand has been drawn slowly at this time, the filaments that comprise the strand are of relatively large diameter and consequently heavy. If the rupture is very abrupt (all of the filaments breaking substantially at once), the collet will whip the broken end of the strand and under the effect of centrifugal force, the broken end will hit the retaining finger 11 and possibly the strand, with a consequent risk of breaking the strand being wound on the collet.

To lessen this risk, it is advisable to obtain a progressive rupture of the filaments of the strand between the rollers 19 and 20 and the starting drum 7. This result is obtained using rollers 19 and 20 of the type illustrated in FIG. 7 and by regulating the pressure with which they engage the strand at a precise value.

Good results were obtained with the following roller characteristics

Pitch circle of the cogs: 15.7 mm
Radius at summit and base of tooth: 4 mm
Total height of tooth: 5 mm Initial clearance: 1 mm
Approximate force of spring 28: 150 N
Possible separation between cogs: 3 mm
Rotation speed: 150 rpm Strand pulling apparatus having roller settings according to the foregoing allow the strand to slide somewhat between the cogs and the filaments are torn progressively so that there is no single large diameter end which can be rotated by the collet and interfere with the winding operation.

In the embodiment discussed above, two slots 10 were carried in the face 9 of the starting drum. Instead of just two slots, an arrangement can be used having a plurality of slots, for example two pairs of slots as shown in FIG. 15, or many slots, as shown in FIG. 15*a*, with the condition that the slots be in pairs, one of the slots of each pair being diametrically opposed to the other slot of the pair.

Referring to FIG. 16, narrow slots 10 with rounded edges 10*a* can also be used. This arrangement makes it sure that the strand will fall into two opposite slots when the strand is drawn by the pulling device.

As shown in FIG. 17, it is advantageous to provide a sprayer device 35 for spraying a jet of water at the drum 7 to wet the face 9. The wetting of the face 9 prevents the collection of sticky materials such as size on the face 9 and consequently:

In the case of the drum with two slots 10 or with slots far apart from one another (4 or 6 slots) maintains the slipperness of surface 9 which comes into contact with the strand and permits passage of the strand into the slots and prevents the strand from sticking to the surface 9.

In the case of the drum having very closely spaced slots, prevents the clogging of the slots by sticky deposits that can cause poor engagement of the strand by the slots.

FIGS. 18 and 19 show apparatus for introducing the strand into the strand pulling device.

The apparatus of FIG. 18 includes a bar 36 moved transversely by a jack. The bar 36 causes the strand to enter between the rollers 19 and 20 after passage of the strand through V-shaped guide 18.

In the variant shown in FIG. 19, the apparatus comprises a rotating V-shaped element 38 that is moved by a rotating jack 39. The V-shaped element 38 acts in the same manner as bar 36 and causes the strand to be introduced between the rollers 19 and 20.

Instead of a strand puller with rollers, one can use an apparatus such as shown in FIG. 20, that comprises a disc 40 having fingers 42 thereon and driven by a motor 41. Also, in place of the cogs shown in FIG. 7, smooth cylindrical rollers can be used. However, the use of such a strand puller is less advantageous than the rollers previously described because the smooth rollers do not permit the obtaining of a progressive breaking of a strand.

Referring to FIG. 21, another embodiment of strand deflector is shown. The fixed retaining finger 11 is replaced by the strand deflector which acts as the upper guide for the strand. The strand deflector used is a known type of deflector. It comprises a bar 15 fixed at one end to a crank 45. When the bar 15 moves to its working position (phantom line position 15*a*) the strand is disengaged from the traversing mechanism 6, the strand being lifted from the transfer bar of that mechanism. Movement of the crank 45 is caused by a rotating jack 46. A fork 47 that is movable the length of the bar 15 pushes the strand or strands to the end of the bar 15. The fork is fixed at one end to bar 48 of a piston of the straight jack 49 mounted on two journals 60 that serve as pivots for the crank 45 carrying the bar 15.

Referring to FIGS. 22 and 23, a V-shaped element 51 is mounted on the end of the bar 15. The purpose of the element 51 is to maintain a strand on the groove 8 of the starting drum. The element 51 is shaped and positioned so that it does not interfere with the fork 47 when the fork 47 moves the strand or strands onto the smooth part 61 of the collet adjacent the groove 8, the smooth part 61 being the portion of the collet on which the transfer ring 53 is formed.

An electric impulse causes the rotation of crank 45 carrying the bar 15 thus removing the strands from the field of action from the traversing mechanism. An impulse consecutive to the first impulse causes the exiting of the bar 48 from the jack 49 and the strands are pushed (FIG. 22) to the end 51 of the bar 15 while the winding of these strands takes place on the starting drum 7, this being the working position of the fork 47.

A modification may be made to the operating panel in order than when all the switches are in "stop" position, the two deflector components 15 and 47 will be in working positions. The position of the fork 47 must be adjusted in order that the strand falls in the groove 8 of the drum, all of the other placements of the system being identical of those described above (guiding finger 11 having been eliminated). When the collet 4 has reached its normal operating speed the fork 47 is progressively retracted and the bar 15 is raised to a rest position.

It should be realized that the foregoing operation must be compatible with the operating sequence of the automatic winders. In this situation, it is fork 47 that positions the strand on the collet. The base of the groove must thus be polished and smooth and must be kept clean as this is an indispensible condition in order to have a successful transfer. Due to the difficulty of cleaning the surface at the base of the groove 8, such an embodiment is less advantageous for obtaining a good winding start.

In the embodiment described above, strand 3 can be wound on the drum of the collet next to the groove 8 on the surface 61 that is easily cleaned. For this reason, the travel of the fork 47 is adjusted by adjustment of the stop element 62 that engages the end of rod 48.

It is advantageous, as represented in FIGS. 24–26, to incline the leading edges 10*a* of the slots that encounter the strand coming into contact with the face 9 of the starting drum. This incline permits the strand to enter the slots more evenly, whatever the starting speed of the collet. With such a slot, the strand, which follows the projectery fl represented in FIG. 26, has less chance of hitting the edge 10*b* of the slot, an occurrence which rapidly rounds out the edge 10*b* under the effect of erosion and consequently allows the strand to escape from the slot.

In the embodiment shown in FIGS. 27 and 28 the apparatus includes fingers 65 on the end of the collet these fingers being four to six in number and in a circular arrangement, the fingers being uniformly spaced from each other.

The strand is wound on these fingers and from there passes into groove 8 through slot 66 provided between the face 67 and the groove 8. As in the embodiment previously described this passage is effected by holding the strand against the face 67. As visible in FIG. 28, it is advantageous to round the edge 68 of the face 67. This avoids breakage of the filaments when the strand, not having been engaged in one of the slots 66, slides along the face 67 toward the following slot.

We claim:

1. Apparatus for attenuating and winding continuous strand drawn from a bushing directly onto winding sleeves mountable on and adapted to extend lengthwise over a portion of a rotating collet comprising, a collet mounted for rotation about the longitudinal axis thereof and adapted for receiving a winding sleeve thereon, a face on one end of the collet disposed substantially normally to the axis of rotation of the collet, strand pulling means for drawing the strand from the bushing across and into engagement with the end face of the collet with portions of the strand extending beyond two points on the periphery of said end face, strand engaging means comprising a multiplicity of angularly displaced strand catching devices associated with said face for engaging portions of the strand brought into proximity to the face at at least two spaced apart points, means for guiding the strand onto the portion of the collet adjacent said face, and means for shifting the strand axially of the portion of the collet adjacent the face and onto a winding sleeve mounted on the collet after said collet has reached operating speed.

2. Apparatus according to claim 1 wherein the strand engaging means on said end face comprises a plurality of pairs of slots and wherein the slots of each pair are diametrically opposed to each other.

3. Apparatus according to claim 2 wherein two pairs of slots are provided and further wherein the slots of one pair are angularly disposed by 90° from the slots of the other pair.

4. Apparatus according to claim 2 wherein the slots are provided by a plurality of closely spaced fin-shaped members having rounded outer edges, said fin shaped members being mounted on said face.

5. Apparatus according to claim 2 wherein the strand engaging means comprises a plurality of fingers outwardly projecting from said face, said fingers being equidistantly spaced from the axis of rotation of the collet, said strand engaging means further comprising a slot adjacent each finger, said slots being inclined toward the collet so as to guide the strand onto the starting drum.

6. Apparatus according to claim 1 wherein said collet is located beneath said bushing and said strand pulling means is located beneath said collet in a vertical plane which is proximate to the axis of rotation of the collet, said strand pulling means further being located axially of the collet so as to partially project beyond the collet end face.

7. Apparatus according to claim 6 wherein said strand pulling means comprises a pair of rollers disposed in side-by-side relationship on axes which are inclined downwardly with respect to the axis of rotation of the collet, the rollers each having one end projecting beyond the face of the collet, said ends being lower than the opposite ends thereof, the peripheral surfaces of the rollers being in contact with one another at said vertical plane to form a strand engaging nip.

* * * * *